US008117871B2

(12) United States Patent
Bauer et al.

(10) Patent No.: US 8,117,871 B2
(45) Date of Patent: Feb. 21, 2012

(54) METHOD AND KNITTING MACHINE FOR PRODUCING A KNITTED PRODUCT FROM SUBSTANTIALLY UNTWISTED FIBRE MATERIAL

(75) Inventors: Wolfgang Bauer, Kornwestheim (DE); Axel Flad, Burladingen (DE); Christine Abt-Seitel, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 12/674,977

(22) PCT Filed: Aug. 1, 2008

(86) PCT No.: PCT/DE2008/001258

§ 371 (c)(1),
(2), (4) Date: Jan. 20, 2011

(87) PCT Pub. No.: WO2009/026875

PCT Pub. Date: Mar. 5, 2009

(65) Prior Publication Data

US 2011/0113831 A1 May 19, 2011

(30) Foreign Application Priority Data

Aug. 28, 2007 (DE) ..... 10 2007 041 171

(51) Int. Cl.
*D04B 35/14* (2006.01)

(52) U.S. Cl. ..... 66/165; 66/9 R; 66/163

(58) Field of Classification Search ..... 66/157, 66/158, 160, 161, 163, 165, 9 B, 9 R
See application file for complete search history.

(56) References Cited

U.S. PATENT DOCUMENTS

| | | | | |
|---|---|---|---|---|
| 3,186,192 | A | 6/1965 | R. Schmidt | |
| 3,461,690 | A * | 8/1969 | Paepke et al. | 66/221 |
| 4,006,609 | A | 2/1977 | Abler | |
| 4,270,369 | A * | 6/1981 | Quay et al. | 66/157 |
| 4,345,446 | A * | 8/1982 | Schaberle | 66/9 B |
| 4,364,243 | A * | 12/1982 | Kunde | 66/9 B |
| 5,174,131 | A | 12/1992 | Cottenceau et al. | |
| 5,768,938 | A * | 6/1998 | Schilling et al. | 73/160 |
| 6,962,065 | B2 | 11/2005 | Willmer | |

(Continued)

FOREIGN PATENT DOCUMENTS

DE 1 123 425 2/1962

(Continued)

*Primary Examiner* — Danny Worrell
(74) *Attorney, Agent, or Firm* — Michael J. Striker

(57) ABSTRACT

A method and a knitting machine for producing a knitted product composed of fiber material fed by a roller pair (11*c*) are described. The stitches are formed as usual by knitting elements (3) being raised out of a non-knitting position into a fiber take-up position, while at the same time previously formed stitches are being knocked over, and being withdrawn again after the fiber material (6) is inserted. The presence of fiber material is monitored by means of a sensor (22), which when there is no fiber material present emits an error signal, as a result of which the knitting elements are prevented from being raised further into the fiber take-up position. According to the invention, when the error signal occurs, the knitting elements (3) are withdrawn from an intermediate position again without the previously formed stitches being knocked over and without the fiber material being taken up. In addition, the sensor is preferably arranged at a location between the roller pair (11*c*) and the knitting system (4) (FIG. 1).

9 Claims, 4 Drawing Sheets

U.S. PATENT DOCUMENTS

| | | | |
|---|---|---|---|
| 7,634,920 | B2 | 12/2009 | Koenig |
| 2004/0221620 | A1 | 11/2004 | Willmer |
| 2006/0272357 | A1 | 12/2006 | Koenig |
| 2009/0064719 | A1 | 3/2009 | Koenig et al. |

FOREIGN PATENT DOCUMENTS

| | | |
|---|---|---|
| DE | 1 585 229 | 11/1970 |
| DE | 1 585 188 | 12/1970 |
| DE | 1 635 844 | 3/1972 |
| DE | 2 115 332 | 10/1972 |
| DE | 35 07 496 | 9/1986 |
| DE | 40 07 253 | 9/1991 |
| DE | 44 08 312 | 9/1995 |
| DE | 44 21 225 | 12/1995 |
| DE | 195 43 229 | 5/1997 |
| DE | 103 21 737 | 12/2004 |
| DE | 10 2006 056 895.8 | 12/2006 |
| DE | 10 2005 031 079 | 1/2007 |
| DE | 10 2006 006 502 | 8/2007 |
| EP | 0 761 585 | 3/1997 |
| EP | 1 518 949 | 3/2005 |
| EP | 1 826 299 | 8/2007 |
| GB | 1 344 330 | 1/1974 |
| PL | 350229 | 12/2002 |
| PL | 350489 | 5/2003 |
| WO | 2004/079068 | 9/2004 |

* cited by examiner

METHOD AND KNITTING MACHINE FOR PRODUCING A KNITTED PRODUCT FROM SUBSTANTIALLY UNTWISTED FIBRE MATERIAL

The invention relates to a method and a knitting machine of the types specified in the preambles of claims 1 and 5.

Known methods and knitting machines referred to as spinning-knitting machines of this type (e.g. PCT WO 2004/079068 A2) are distinguished by the fact that the knitting product is not produced from usual twisted yarns, but from a fibre material provided in the form of a sliver, which is formed from substantially untwisted staple fibres arranged parallel to one another. This sliver is fed to the knitting systems by means of drafting devices known from spinning technology. To transport the sliver from the drafting devices to the knitting systems, the sliver is firstly converted by means of spinning and transport devices, which each contain at least one twist element and a transport tube connected thereto, into a temporary yarn with a plurality of twists, which are maintained during the entire transport operation. As a result of this, it is possible to transport the sliver over longer distances despite its low strength compared to usual yarns. The twists in the temporary yarn are then reduced to zero (false twist effect) over the short distance from the outlet end of the spinning or transport device to the inlet of the sliver into the knitting elements, so that the fibre material actually processed in the knitted fabric does not consist of a twisted yarn, but of a substantially untwisted sliver. As a result, a knitted product of extreme softness is obtained as end product.

Alternatively, however, the spinning device can also be fitted for the formation of a permanently bonded yarn, in particular a so-called unconventional yarn, and be configured, for example, as an air spinning device (cf. e.g. patents EP 1 518 949 A2 and EP 1 826 299 A2). Such a yarn also has some twists or windings, but, like a bundle or covering yarn, for example, it is not a yarn in the classic sense. The spinning operation is preferably set so that, like in the above-described case of the temporary yarn, a sliver that is sufficiently firm for the desired transport purposes is formed, but a sufficiently soft knitted product is still obtained.

Moreover, knitting machines, in particular circular knitting machines, are known (PL 350 489 A), to which drafted and substantially untwisted fibre material is fed by guiding a fibre material preferably provided in the form of flyer frame sliver through the clamping gap between two feed rollers and subjecting it to a preselected drafting process between this roller pair and an associated work area of the knitting machine.

As in the case of conventional methods and knitting machines, there is the disadvantage that a break or run-out of the sliver results in holes in the knitted product or even causes the already formed tubular knit to drop off the knitting elements. This is caused by the knitting elements being raised further into a fibre take-up position despite there being no sliver feed, and the previously formed stitches being knocked over from the knitting elements as a result. The term "knocking over" is to be understood to mean that, irrespective of the type of knitting elements (e.g. latch needles, compound needles, hook-shaped elements etc.), as these are raised into a fibre take-up position the old stitches firstly slip onto a blade of the knitting elements and when the knitting elements are later lowered, slide over their hooks and the newly formed stitches slide off the knitting elements completely.

It is therefore known (DE 10 2005 031 079 A1) to monitor the feed of the sliver with a monitoring device that has thread sensors and is configured in the same way as usual thread monitors. If the monitoring device detects a fault, an error signal intended to switch off the knitting machine and the drafting device is then generated.

The sensors of the known monitoring device are arranged at a location lying in front of the drafting device in the transport direction of the sliver. This should prevent the drafting device from running empty and remove the necessity for a complicated insertion of a new sliver, which is associated with various disadvantages. Moreover, the objective is to stop the knitting machine before the end of the sliver reaches the respective knitting system.

However, the known procedure leads to two disadvantages. Firstly, a break in the sliver in a region located between the monitoring device and the knitting machine cannot be detected, and therefore the formation of holes or detachment of the tubular knit cannot be prevented if the fault in the sliver occurs before it runs into the drafting device. Secondly, it is not at all assured that the knitting machine will come to a standstill before the end of the sliver reaches the respective knitting system, since this is substantially dependent on the length of the drafting device, its distance from the knitting machine and the "stopping distance" of the knitting machine used in the individual case, in particular is dependent on the needle cylinder thereof, for example, if this is a circular knitting machine with a rotatable needle cylinder. Therefore, the sensors would have to at least be so far removed from the fibre inlet points into the knitting systems that the sections of the slivers located inbetween are also sufficient at the highest conceivable speed of the knitting machine to cover the existing sliver requirement up to the final machine stoppage.

In addition, it has already been proposed (DE 10 2006 056 895) to configure the knitting machine of the aforementioned type so that a single knitting system is switched over to non-knitting operation if no fibre material is present or if any other fault occurs, and conduct the switchover automatically by means of a thread monitor. No further details are evident from this proposal. Regardless of this, the formation of longer holes in the knitted product cannot be securely avoided in this way, since the length of such holes is dependent on the time actually required for the switchover to be completed.

Working from this, the technical problem of the present invention is to configure the aforementioned methods and knitting machines so that the holes that occur in the knitted product when a sliver breaks or similar can be kept comparatively short and virtually all the breaks that occur in the sliver can be detected.

This object is achieved by the characterising features of claims 1 and 5.

The invention provides the advantage that monitoring occurs at a location that lies between a roller pair, which is the withdrawal roller pair of a drafting device or a feed roller pair according to PL 350 299 A2, for example, and the knitting system, and the knitting elements are raised out of an intermediate position again without thread take-up. Therefore, on the one hand, the sensors of the monitoring means can be arranged in very close proximity to the respective knitting system, if required, with the result that breaks or the like of the sliver that occur directly in front of the knitting systems can also be reliably detected. On the other hand, because of the special control of the knitting elements it is possible to keep the number of knitting elements, which will still unavoidably move into the fibre take-up position after an error signal occurs, and thus also the resulting holes in the knitted product, as low as possible even when the sections of the slivers located between the sensors and the fibre inlet points are comparatively short.

Further advantageous features of the invention are evident from the sub-claims.

The invention will be explained in more detail on the basis of exemplary embodiments in association with the attached drawings.

FIG. 1 schematically shows a circular knitting machine suitable for the purposes of the invention for the production of knitted products from fibre materials, which substantially comprise untwisted staple fibres;

Figure 1:
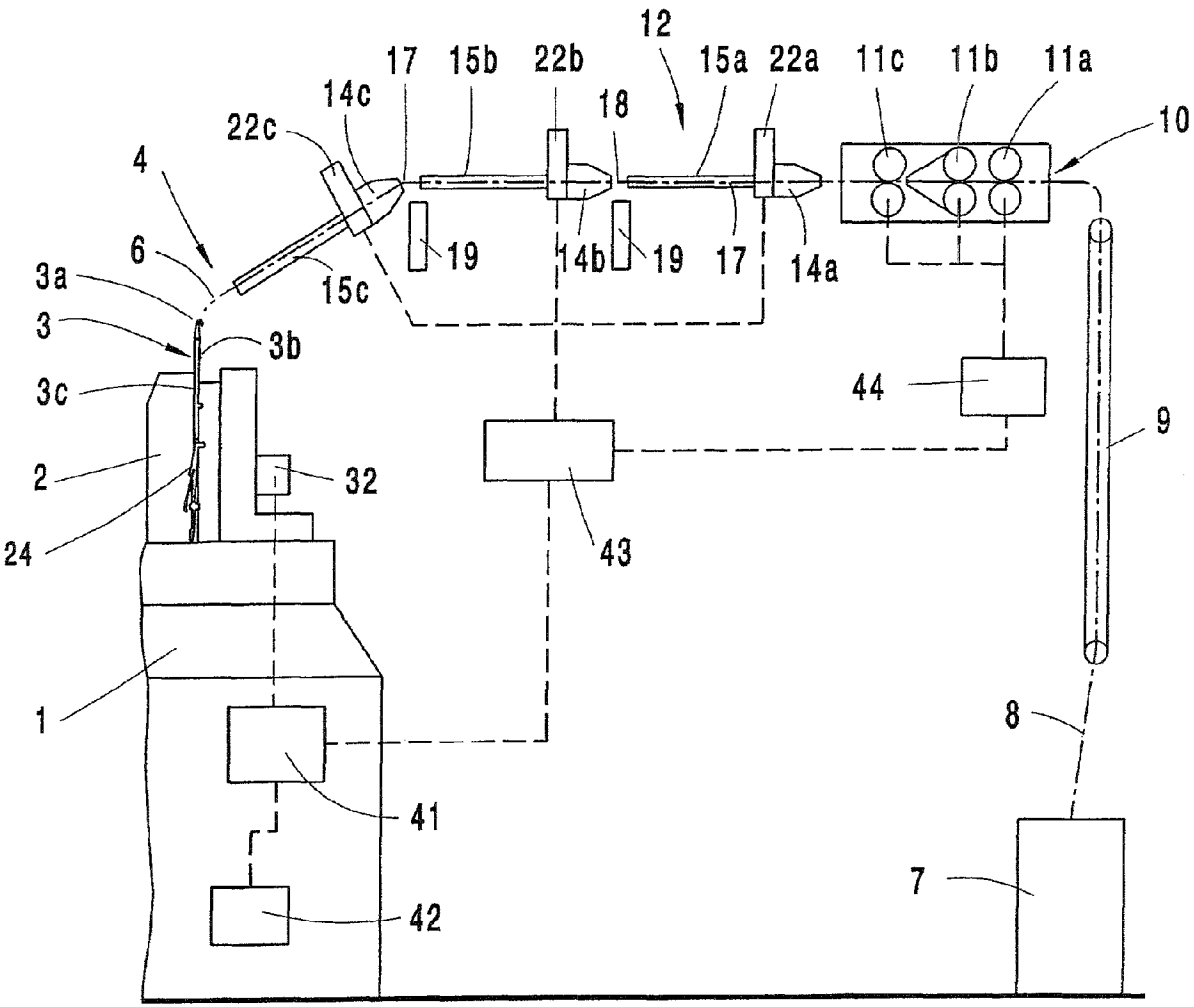

FIG. 1 is a highly schematic vertical view in partial section of a circular knitting machine 1 with a needle cylinder 2, in which usual knitting elements in the form of latch needles 3 are displaceably disposed, which have hooks 3*a* and pivoting latches 3*b* and at a knitting point referred to hereafter as knitting system 4, can be moved into a fibre take-up position suitable for taking up fibre material 6 by means of cams 5 (not further shown). The circular knitting machine 1, which can be configured as a plain circular knitting machine, for example, stands on a schematically indicated floor of a workshop or knitting room. An operator can operate the knitting machine 1 from the workshop floor. In addition, a plurality of cans 7, in which card slivers 8 consisting of fibres are deposited, for example, are placed on the workshop floor.

The card slivers 8 are fed to a drafting device 10 by means of transport elements 9 (not shown in more detail). Each of a plurality of knitting systems 4, of which only one is shown in FIG. 1, has such an associated drafting device 10, which in a manner known per se has, for example, three pairs of drafting rollers 11.

The fibre material coming out of the drafting device 10, which consists of substantially untwisted staple fibres arranged parallel to one another, is fed in the known manner to an associated knitting system 4 by means of a spinning or transport device given the general reference 12. The transport device 12 contains at least one twist element 14 and a spinning or transport tube 15 connected to this, wherein in the exemplary embodiment according to FIG. 1 three twist elements 14*a*, 14*b*, 14*c* and transport tubes 15*a*, 15*b*, 15*c* are connected one behind the other because of the comparatively substantial distance of the circular knitting machine 1 from the drafting device 10. The first twist element 14*a* in the transport direction of the fibre material is arranged directly behind a withdrawal roller pair 11*c* of the drafting device 10, whereas the last transport tube 15*c* in transport direction terminates very close to the hooks 3*a* of the latch needles 3 raised into a fibre take-up position on the respective knitting system 4.

The spinning device 12 or each transport unit comprising a twist element 14 and transport tube 15 serves to initially convert the sliver discharged from the drafting device 10 into a temporary yarn 17 with genuine twists. For this purpose, the twist element 14 is formed, for example, from a substantially hollow cylindrical body, the inside cavity of which receives the leading section of the transport tube 15, and has at least one air duct, preferably multiple air ducts, which are all arranged on an angle to the centre axis of the transport tube 15. The air ducts pass through the wall of the body and the transport tube 15 and terminate at an inside wall of the transport tube 15. During operation, compressed or blast air is fed to the outer ends of the air ducts by means (not shown), so that the twist element 14 pulls the fibre material fed by the withdrawal roller pair 11*a* into the transport tube 15 and at the same time also directs it on through the transport tube 15 in the direction of the respective knitting system 4. In addition, because of the sloping arrangement of the air ducts air is swirled in the transport tube 15 in such a manner that the fibre material coming from the withdrawal rollers 11*c* is not only sucked up, but is also spun into a temporary yarn by giving it a plurality of twists, which at the same time compress the fibre material. The temporary yarn 17 retains the twists substantially until the end of the last transport tube 15*c*, whereupon these twists are then released again, i.e. are reduced to zero (false twist effect), until the last received fibre material 6 enters the knitting needles 3. Therefore, a compressed, but virtually untwisted, sliver 6 enters the knitting needles 3. Between the different transport units 14, 15 a respective gap 18 with an associated extraction means 19 is preferably provided to extract excess air coming from the twist elements 14 and loose impurities located in the fibre material.

Figure 2:
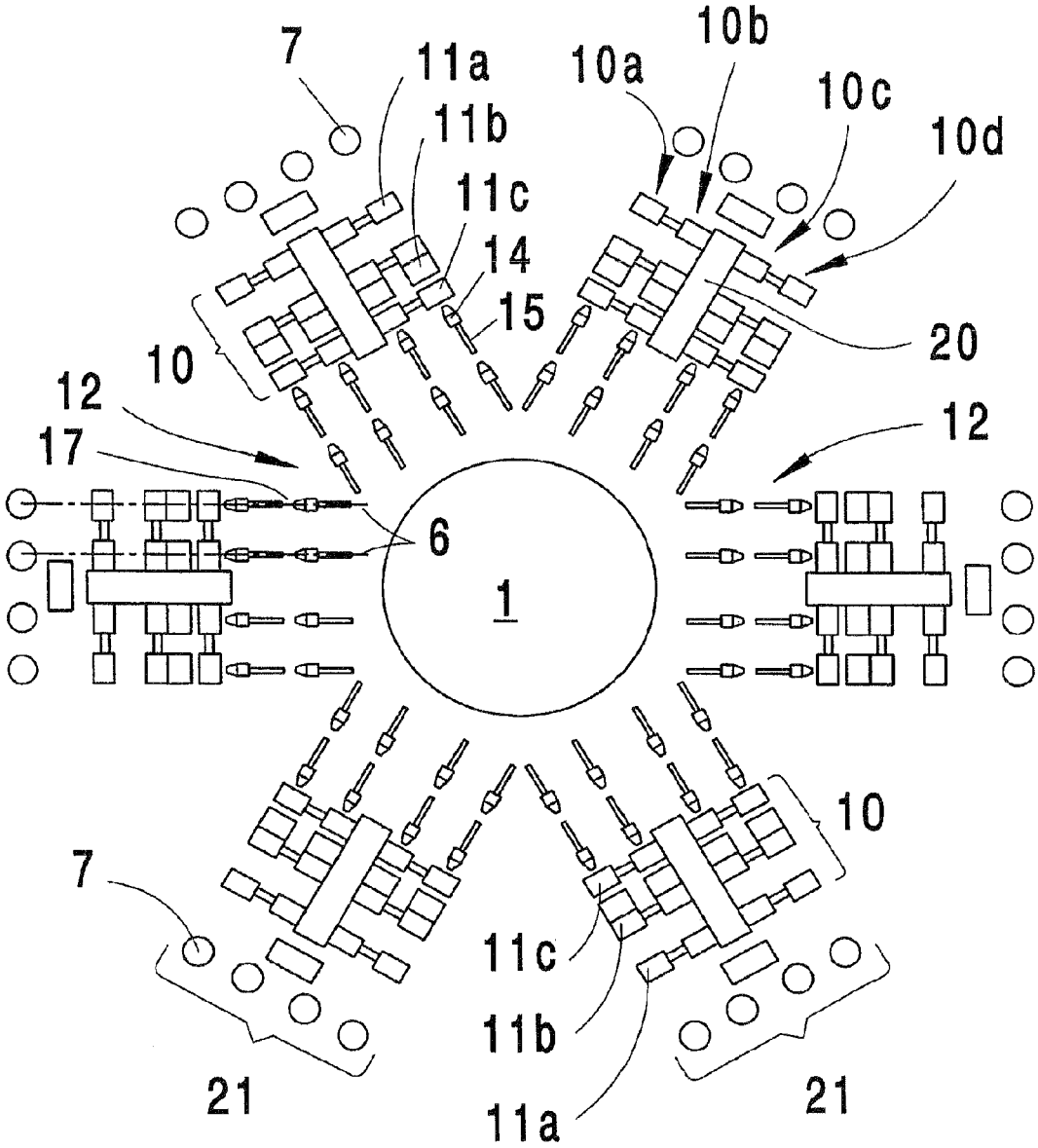
FIG. 2 is a schematic plan view onto a circular knitting machine according to FIG. 1 with a multiplicity of knitting systems.

In a schematic plan view FIG. 2 shows that a multiplicity of devices according to FIG. 1 are distributed around the periphery of the circular knitting machine 1, the spinning and transport device 12 only having two respective transport units 14, 15 here. Moreover, a special feature of the exemplary embodiment is that four respective drafting devices (e.g. 10*a*, 10*b*, 10*c* and 10*d*), which each guide a sliver, are arranged adjacent to one another in pairs, are fastened on opposite sides of a common mounting 20 and are combined to form a drafting device group 21. Moreover, each drafting device group 21 has two drives (not shown), of which one drives all four feed and central rollers 11*a*, 11*b* and another drives all four withdrawal rollers 11*c* of the respective drafting roller group 21. The circular knitting machine 1 shown in FIG. 2 is therefore provided with 24 individual drafting devices, which each feed a respective sliver 6 to one of 24 knitting systems.

Circular knitting machines of the described type are known, for example, from document PCT WO 2004/079068 A2 and DE 10 2006 006 502 A1, which are herewith incorporated into the present disclosure by reference to avoid repetition.

According to the invention, the described circular knitting machine 1 is provided on each knitting system 4 with at least one sensor 22, which is suitable for detecting the presence or absence, and particularly advantageously also the movement and stoppage, of the fibre material being fed to the knitting system 4, and which is arranged at a location that is preferably located between the withdrawal roller pair 11*c* of the drafting device 10 and the knitting system 4. This monitoring can be achieved on the basis of the sliver 6 discharging from the last transport tube 15*c* of the transport device 12, on the basis of a temporary yarn 17 guided in the gaps 18 between two transport units 14, 15 or also on the basis of a temporary yarn 17 guided in a transport tube 15. In the last-mentioned case, the respective transport tube 15 preferably has a window or an intermediate section made of a fully transparent material, through which the temporary yarn 17 can be detected by the sensor 22. In the exemplary embodiment of FIGS. 1 and 2, three such sensors 22*a*, 22*b* and 22*c* are respectively provided for each system, which are each associated with a transport tube 15*a*, 15*b*, 15*c*. It is particularly advantageous if at least one sensor 22 is arranged as closely as possible to the respective knitting system 4, so that breaks occurring there or other faults in the fibre material can also be discovered.

Usual sensors that are used as thread monitors in normal knitting machines can be provided as sensors 22, which in the absence or stoppage of the fibre material to be monitored emit an electrical error signal. This error signal is used according to the invention to no longer allow the needles 3 passing through the respective knitting system 4 to pass into the fibre take-up position, but to be raised out of an intermediate position again without taking up any fibre. This process is shown schematically in FIGS. 4 and 5.

Figure 3:
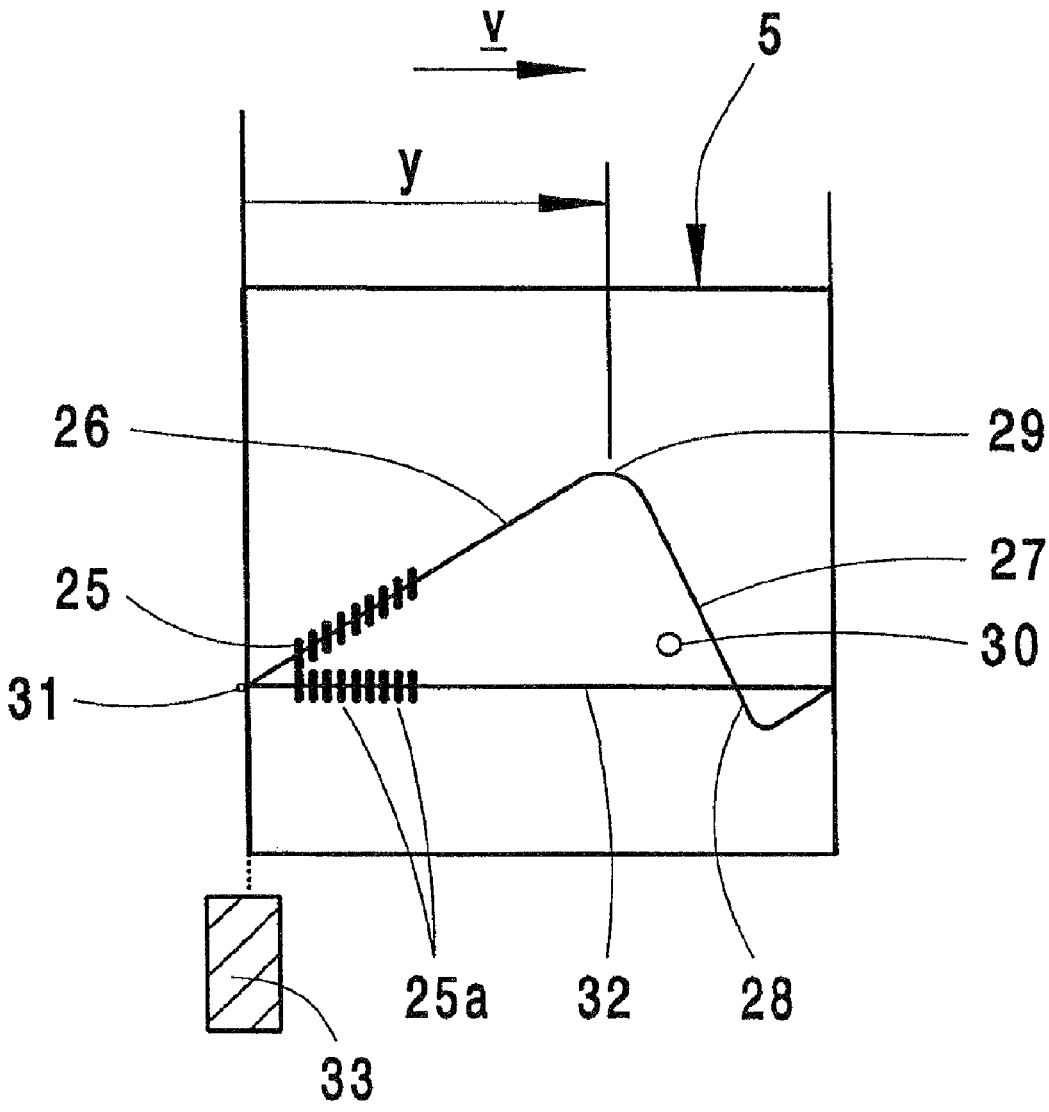
FIGS. 3 and 4 are front views of possible cams for the knitting machine according to FIG. 1.

It is presumed in FIG. 3 that the needles 3 themselves or selectors or jack selectors 24 associated with them (FIG. 1), like in usual knitting machines, are provided with raising butts 25 (FIG. 3), which interact with the cams 5 arranged on the knitting systems 4. As a result, all the needles 3 are firstly raised, for example, out of a through- or non-knitting position along a raising path 26 into a fibre take-up position and then withdrawn again along a withdrawal path 27 in order to advance them again into the through-position after passing through a cast-off or coulier path 28. The movement of the needles 3 in relation to the cams 5 occurs in the direction of an arrow v in FIG. 3. The fibre take-up position is reached close to a highest point 29 of the raising path 26 and serves to arrange the needles 3 in a position where they are raised to such a distance that the stitches located in their hooks 3*a* and formed in a preceding knitting system 4 slide over the open latches 3*b* onto a needle blade 3*c* (FIG. 1), while the fibre material 6, e.g. at a location 30 that indicates a thread guide eyelet, can be advanced so that it is laid in the hooks 3*a* of the needles 3 at the latest during their withdrawal. However, the withdrawal of the needles 3 serves to pull the inserted fibre material 5 through the previously formed stitches suspended on the needle blades 3*c* and at the same time fully knock over the old stitches over the hook 3*a* as the latch 3*b* closes.

To prevent the needles 3 from being further raised into the fibre take-up position when a break or similar of the fibre material occurs and thus knock over the old stitches without taking up fibre material again, a branch 31 can be provided at the beginning of the raising path 26 according to FIG. 3, at which branch the butts 25 can be guided selectively onto the raising path 26 or into a through-path 32, as is indicated for some butts 25*a*. For example, an electromagnet 33 arranged in the region of the branch 31 can serve as selector means, as is generally known in the case of needle control systems. This electromagnet 33 could be controlled so that in response to an error signal of a sensor 22, all the needles 3 on the respective knitting system 4 are directed into the through-path 32. As a result of this, the old stitches are prevented from being knocked over.

However, the described control is not optimal, since in FIG. 3 all the needles 3 arranged to the right of the selector magnet 33 have already gone past the branch 31 when the error signal occurs and therefore can no longer be prevented from being raised into the fibre take-up position. This results in a hole forming in the knitted product, the length of which corresponds at least to a length y indicated in FIG. 3, since at least all the needles 3 located in region y still knock over their stitches before reaching the fibre take-up position. The size of such a hole depends on the individual case, the needle pitch and other properties.

Figure 4:
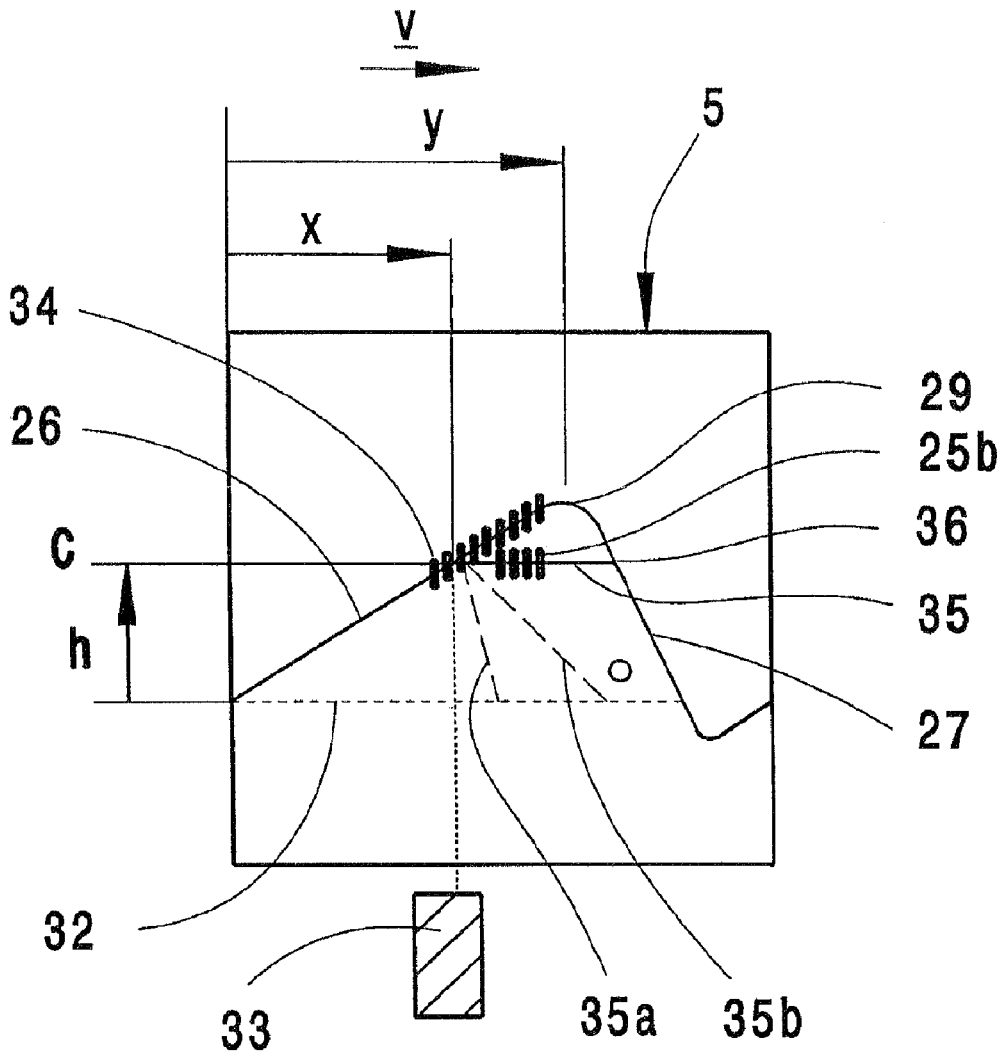

Therefore, it is proposed according to the invention to arrange a branch 34 and the associated selector magnets 33 in the raising path 26 and at a height h above the through-path 32, as shown in FIG. 4. It is additionally proposed to connect the branch 34 to an intermediate path 35, which leads past butts 25*b* arranged on it below the fibre take-up position and allows it to feed into the withdrawal path 27 at a location 36 in order to ensure that the associated needles 3 do not take up any fibres. Moreover, the height h is dimensioned such that because the raising action occurred by the time the branch 34 was reached, the latches 3*b* of the needles 3 are already open in accordance with FIG. 5, while the old stitch indicated by a thread 37 is arranged just above the free latch tip and therefore cannot pass under the latch 3*b* onto the needle butt 3*c* during transport of the needle 3 along the intermediate path 35.

This measure assures that, when an error signal emitted by the sensor 22 occurs, it is only those needles 3 that have already passed the branch 34, i.e. that are already arranged in a section y-x of the knitting system 4, that can no longer be directed into the intermediate path 35 by the selector magnet 33. Conversely, all those needles 3 that are located in a region x in FIG. 4 can still be directed into the intermediate path 35 by the selector magnet 33. The section y-x, within which the needles 3 can no longer be prevented from knocking over the old stitches, is therefore substantially narrower than dimension y, so that a hole in the knitted product caused by fibre material 6 not being present also has a correspondingly reduced length. The length of the hole is therefore reduced overall by the dimension x in comparison to FIG. 3.

Figure 5:
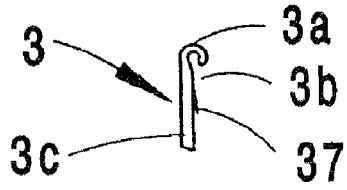
FIG. 5 shows a latch needle of the circular knitting machine according to FIG. 1 located in a fibre take-up position according to the invention.

Moreover, the arrangement according to FIG. 4 has the advantage that the needles 3 are raised into an intermediate position C (FIG. 4), which is defined by the position of the branch 34 and can be optimised in the sense of FIG. 5. The intermediate path 35 can be placed at any desired expedient height h, so long as it only lies between the through-path 32 (FIG. 3) and the highest point according to FIG. 5, at which the old stitches have not yet been knocked over. Moreover, it is advantageous to optimise dimension x in accordance with knitting-related design features and to be as large as possible, while selecting the horizontal distance between the branch 34 and the location 30, at which the fibre materials are taken up by the needles, and thus also the number of needles that do not take up any fibres in the event of a break in the fibre material, to be as small as possible.

FIG. 1 shows the connection of the sensors 22 to the rest of the control elements of the circular knitting machine 1. This includes as central control element in particular a standard machine control unit 41, which is connected via electric lines to a machine drive 42 and the selector magnets 33 in the same way as e.g. for circular knitting machines with electronic selector devices for the knitting needles that can be controlled by electromagnets. A microprocessor 43 is additionally provided according to the invention, which is connected on one side to the machine control unit 41 and on the other side to the sensors 22 and also a control device 44, which serves to control the different drives of the drafting devices 10.

Two preferred methods for controlling the circular knitting machine 1 are provided in particular for the purposes of the invention. Both methods work on the basis of a design of the drafting devices 10 shown in FIG. 2, according to which two respective adjacent drafting devices 10 arranged on the same side of the mountings 20 form a pair. The top rollers of the two drafting devices 10 of this pair are respectively rotatably disposed on a common press arm or swinging support. Each press arm is biased on one side by a spring or the like in a known manner in order to press the top rollers against the bottom rollers with a preselected force and on the other side is disposed to pivot on a drafting roller housing, so that this can be opened for repair and maintenance work. It is additionally provided according to FIG. 2 that each drafting device group 21, which consists of four drafting devices 10 mounted on the same mounting 20, has two associated motors, of which one serves to drive the feed and central rollers 11*a*, 11*b* and the other to drive the withdrawal rollers 11*c*.

On this basis, the first method for controlling the circular knitting machine 1 provides that an error signal, which is fed to the microprocessor 43 by any one sensor 22 and indicates the presence of a sliver 6 or temporary yarn 17, is forwarded immediately to the machine control unit 41. This transmits a control signal to the selector magnet 33 of the associated knitting system 4 so that all the needles 3 passing the selector magnets 33 are immediately directed into the intermediate path 35 (FIG. 4) and are therefore no longer raised into the fibre take-up position 29. The implementation of this measure can occur very quickly despite the unavoidable signal running and calculation times caused by the electronic system. Therefore, as described above, with the exception of few additional needles, only those needles 3 that had already passed the selector magnets 33 when the fault occurred are no longer detected. However, all following needles 3 pass into the intermediate path 35, so that a hole forming in the knitted product is thus comparatively short.

When the error signal occurs, the machine control unit 41 continues to send a control signal to the machine drive 42 to thus stop the drive motor for the circular knitting machine 1 or the needle cylinder 2. The needle cylinder 2 thus comes gradually to a standstill, during which it still makes a quarter or half rotation, for example. However, this stopping time is of no importance for knocking over stitches from the needles 3, since this has already been prevented by the switchover of the selector magnet 33.

Finally, a control signal is also transmitted via the microprocessor 43 to the control device 44, whereupon this also stops the drive motors of all the drafting devices 9 synchronously with the stoppage of the circular knitting machine 1 or the needle cylinder 2.

After stoppage of the circular knitting machine 1, the damage at the respective drafting device 10 can be remedied and the circular knitting machine 1 can then be manually restarted by means of a corresponding switch on the machine control unit 41. As a result, the sensor 22, which has emitted the error signal, can be brought into its active monitoring state again by means of the microprocessor 43, while the drives of the drafting devices 10 are switched on again. However, the selector magnet 33 of the knitting system 3 affected by the fault is only brought into the state, in which it directs all passing needles 3 into the raising path 26 at the branch 34 (FIG. 4), when the respective sensor 22 indicates that the drafting device 10 monitored by it is feeding fibre material again and is moving the fibre material, i.e. transport is occurring in the direction of the needles 3.

If according to the above description two respective adjacent drafting devices 10 are connected to the same press arm, then when an error signal occurs, the selector magnet 33 of the knitting system 4 belonging to the adjacent drafting device 10 of the same pair is also switched over automatically in the described manner. This is expedient because elimination of the indicated fault generally requires the common press arm to be opened, as a result of which the fibre flow in the actually intact adjacent system is also interrupted or at least disturbed. As a result of the joint switchover of the two adjacent systems to the intermediate path 35, it is possible in a simple manner to create the same conditions in both adjacent drafting devices 10 of a pair before the circular knitting machine 1 starts again.

The procedure is similar if the top rollers of more than two drafting devices 10 are connected to a common press arm.

The second preferred method according to the invention provides causing the circular knitting machine 1 to continue running despite detection of a fault by one of the sensors 22. This can be expedient to avoid substantial outage periods, if an immediate removal of the fault is not possible or desirable for some reason.

In this case, when a fault is indicated by one of the sensors 22, not only the needles 3 on those two knitting systems 4 belonging to the pair affected by the fault are directed into the intermediate path, but also the needles 3 of those knitting systems 4 belonging to the two other drafting devices 10 of the respective drafting device group 21 in FIG. 2. In addition, the two drive motors of this drafting device group 21 are switched off by means of the control device 44 in order to prevent fibres from continuing to be fed to the respective systems 4 even though no further fibres are being taken up. As a result, the circular knitting machine 1 is now in a state, in which a complete drafting device group 21 is no longer operating. Nevertheless, the circular knitting machine 1 can be further operated without problem, since in the exemplary embodiment the outage of a drafting device group 21 only results in there being four less stitch rows than usual for each needle cylinder revolution, since a stitch row is formed on each knitting system 4. So long as all the remaining knitting systems 4 work perfectly, this indeed leads to a reduction in production, but does not result in a decrease in quality of the produced knitting goods in most cases. A reduction in quality can also be prevented because the take-off device of the circular knitting machine 1 is adjusted to the reduced output by means of the machine control unit 41.

If at any time later there is a need to eliminate the fault present on the stopped drafting device group 21, then the circular knitting machine 1 can be stopped manually and the fault removed by opening and closing the respective drafting device 10 in a similar manner to that described above. The circular knitting machine 1 is then restarted manually, wherein the selector magnets 33 belonging to the drafting devices 10 of the respective drafting device group 21 remain in switched over position until all the respective sensors 22 detect fibre material again, preferably moving fibre material. The selector magnets 33 are then switched over to also raise the needles 3 on the knitting systems 4 controlled by them into the fibre take-up position again. However, it is also alternatively possible to remove the fault with the machine running and then switch over the selector magnets 33 again without stopping the machine as soon as the sensors 22 detect the transport of fibre material. It can be expedient with both described methods to briefly switch off all the sensors 22*a*, 22*b* and 22*c* present on the circular knitting machine 1 after a machine stoppage in order to prevent control errors when the circular knitting machine is restarted. Moreover, it is advantageous to also incorporate the twist elements 14 and suction devices 19 into the described control in order to adapt the blast and suction air flows associated with these to the respectively changed operating conditions by means of suitable regulator devices or the like.

The procedure is similar if a plurality of sensors 22 emit an error signal at the same time.

Both methods can be applied analogously if the fibre material fed to the knitting system 4 is supplied by a feed roller pair in accordance with patent PL 350 489 A, i.e. when a classic drafting device is not present.

For control of the needles 3 in the sense of FIG. 4, patterning devices used hitherto predominantly for needle selection in the 3-way technique are suitable (e.g. DE 40 07 253 C2 and DE 103 21 737 A1). There, it is generally known to selectively control needles with a first selector magnet into a through-path or into a raising path, as is shown in FIG. 3. The needles guided on the raising path can then be selectively directed by means of a second selector magnet into a catch position or be moved on in the raising path and into a thread take-up position, as shown in FIG. 4. However, according to the invention the selector magnets serving to select between the through-path and the raising path could be omitted, since the needles are normally all controlled into the thread take-up position during spinning-knitting.

It is clearly evident to the person skilled in the art that instead of electromagnetic selector means that allow a single selection of the needles 3, selector arrangements in the form of electrically controllable cam switches, which can be switched over between a fibre take-up position and an intermediate position, can also be used (e.g. DE 1 123 425, DE 35 07 496 C2) to direct the needles into an intermediate path when a break in the fibre occurs. In addition, switchable cams or pivoting swing levers (e.g. DE 15 85 229 C2) can be used to control the needles 3 into the intermediate path 35. Purely electrical patterning devices, e.g. operating with piezoelectric elements (e.g. DE 21 15 332 C3) or pneumatically operating patterning devices (e.g. DE 15 85 188) can also be used. It is not particularly significant for the purposes of the invention what means are used to direct the needles 3 into the intermediate path 35 when a fault occurs in the sliver.

Moreover, other knitting elements such as e.g. compound needles, for which the likewise electromagnetic selector devices are known (e.g. DE 16 35 844 C3), can also be used instead of the latch needles 3. The application of hook-shaped knitting elements is also possible in this context.

Suitable sensors within the framework of the present invention are in particular all those sensors that are also suitable for monitoring normal knitting yarns and that operate optically, mechanically or purely electronically (e.g. DE 44 21 225 A1, EP 0 761 585 A1, DE 195 43 229 A1 or DE 44 08 312 C2).

All the abovementioned documents are herewith incorporated into the present disclosure by reference to avoid further repetition.

The invention is not restricted to the described exemplary embodiments, which can be modified in a variety of ways. In particular, it is clear that the intermediate path 35 evident from FIG. 4 does not necessarily have to run exactly parallel to the through-path 32 at the height of the intermediate position C of the needles 3. According to a particularly preferred exemplary embodiment, the intermediate path 35 instead has a quite steep downward slope adjoining the branch, as is indicated by broken lines 35*a* and 35*b* in FIG. 4. The intermediate path 35 does not then open into the withdrawal path 27 at location 36, but into the through-path 32 at a location lying more in front of the thread guide eyelet 30, and therefore the needles 3 are withdrawn earlier—viewed in the transport direction—than if they were to run into the withdrawal path 27 only at the location 36. This results in the advantage when spinning on a knitting system or on all knitting systems of the knitting system that sections of fibre material already inserted into the needle circle can definitely not be engaged by the needles 3 transported along the intermediate path 35 or pass between these. In order to avoid steep cams, the slightly flatter course 35*b* is regarded as currently the best embodiment of the invention. Moreover, the control system of the circular knitting machine 1 evident from FIG. 1 only represents one example that can be varied in a variety of ways. This also applies to the position and number of sensors 22*a*, 22*b* and 22*c* shown in FIG. 1, which could also lie at any other location on the path of the fibre material, e.g. in or in front of a drafting device. In principle, it is sufficient to provide a single sensor 22 for each knitting system 4. Moreover, it is not necessary to arrange the drafting devices 10 according to FIG. 2 in pairs of two and groups of four drafting devices. For the purposes of the invention, arrangements are also suitable, in which each individual drafting device 10 is arranged and driven separately. Moreover, in addition to sensors 22, further sensors intended for monitoring the fibre flow can also be provided on the knitting machine, in particular such sensors that are arranged in front of the drafting devices in the transport direction of the fibres in a manner known per se. Finally, it is clear that the different features can also be applied in other combinations than those described and represented.

The invention claimed is:

1. Method for producing a knitted product on a knitting machine (1) having knitting elements (3) and at least one knitting system (4), wherein the formation of the stitches is achieved by the knitting elements (3) being raised out of a non-knitting position into a fibre take-up position, while at the same time previously formed stitches are being knocked over, and being moved into the non-knitting position again after a drafted sliver (6) fed by a roller pair (11*c*) is inserted, and wherein the presence of fibre material (6, 17) is monitored, if there is no fibre material (6, 17) an error signal is generated, and as a consequence thereof the knitting elements (3) are prevented from being raised into the fibre take-up position, characterised in that when the error signal occurs the knitting elements (3) are withdrawn from an intermediate position (C) again without the previously formed stitches being knocked over and without the sliver (6) being taken up.

2. Method according to claim 1, characterised in that a plurality of drafting devices (10) are combined to form drafting device groups (21) and when an error signal occurs in one of the drafting devices (10) of this drafting device group (21) only the drives serving to operate this are switched off, while the circular knitting machine continues to be operated with the remaining drafting devices (10).

3. Method according to claim 1, characterised in that a plurality of drafting devices (10) are combined into pairs and when an error signal occurs in a drafting device (10) of these pairs, the drive of the knitting machine (1) and the drives of all the drafting devices (10) are shut down.

4. Method according to claim 1, characterised in that the monitoring occurs at a location lying between the roller pair (11*c*) and the knitting system (4).

5. Knitting machine with knitting elements (3) and at least one knitting system (4), comprising: at least one assembly (10) associated with the knitting system (4) with a roller pair (11*c*) for feeding a drafted sliver (6) to a fibre take-up point, means (26, 27) associated with the knitting system (4) for raising the knitting elements (3) out of a non-knitting position into a fibre take-up position (29), while at the same time previously formed stitches are knocked over, in order to take up the sliver (6) at the fibre take-up point and to subsequently move the knitting elements (3) into the non-knitting position, and a monitoring means for the sliver (6) having at least one sensor (22) so that when there is no sliver (6) present, the knitting elements (3) are prevented from being raised into the fibre take-up position, characterised in that the means (26, 27) is configured so that when the sliver (6) is not present, the knitting elements (3) are withdrawn from an intermediate position (C) again without the previously formed stitches being knocked over and without the sliver (6) being taken up.

6. Knitting machine according to claim 5, characterised in that the means contains a branching point (34) formed from cams for butts (25) of the knitting elements (3) or control elements (24) associated with these and an electrically controllable selector device (33) associated with the branch (34), by means of which the needles (3) can be directed into an intermediate path (35) when an error signal from the sensor (22) occurs.

7. Knitting machine according to claim 5, characterised in that the knitting elements (3) comprise latch needles and the intermediate position (C) is selected in such a manner that previously formed stitches still lie on the opened latches (3*b*).

8. Knitting machine according to claim 6, characterised in that from the branch (34), the intermediate path (35) has a course (35*a*, 35*b*) descending in the direction of a through-path (32).

9. Knitting machine according to claim 5, characterised in that the sensor (22) is arranged at a location lying between the roller pair (11*c*) and the knitting system (4).

* * * * *